US009395106B2

(12) United States Patent
Voorhis

(10) Patent No.: US 9,395,106 B2
(45) **Date of Patent: *Jul. 19, 2016**

(54) SYSTEM AND METHOD FOR COOLING POWER ELECTRONICS USING HEAT SINKS

(71) Applicant: TRANE INTERNATIONAL INC., Piscataway, NJ (US)

(72) Inventor: Roger J. Voorhis, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/616,945

(22) Filed: Feb. 9, 2015

(65) Prior Publication Data

US 2015/0153075 A1 Jun. 4, 2015

Related U.S. Application Data

(63) Continuation of application No. 13/435,653, filed on Mar. 30, 2012, now Pat. No. 8,950,201.

(51) Int. Cl.
*F25B 5/00* (2006.01)
*F25B 5/02* (2006.01)
(Continued)

(52) U.S. Cl.
CPC . *F25B 5/02* (2013.01); *F25B 13/00* (2013.01); *F25B 30/06* (2013.01); *F25B 31/006* (2013.01);
(Continued)

(58) Field of Classification Search
CPC ..... F25B 2313/021; F25B 2313/02741; F25B 30/06; F25B 5/02; F25B 41/04; F25B 31/006
See application file for complete search history.

(56) References Cited

U.S. PATENT DOCUMENTS 3,388,559 A 6/1968 Johnson
3,656,540 A 4/1972 Henrici
(Continued)

FOREIGN PATENT DOCUMENTS

CN 1266978 9/2000
CN 1395071 2/2003
(Continued)

OTHER PUBLICATIONS

International Search Report and Written Opinion for International Application No. PCT/US2013/034252, dated Aug. 6, 2013, 8 pgs.
(Continued)

*Primary Examiner* — Marc Norman
*Assistant Examiner* — Ana Vazquez
(74) *Attorney, Agent, or Firm* — Hamre, Schumann, Mueller & Larson, P.C.

(57) ABSTRACT

A system and method for cooling power electronics using heat sinks, and including a heat pump. The heat pump includes a main refrigerant circuit having a compressor, an indoor heat exchanger, and an outdoor heat exchanger, and a reversing valve. A biflow expansion valve is configured to receive condensed liquid refrigerant and to expand the refrigerant. A cooling circuit in fluid communication with the main refrigerant line includes an expansion device configured to receive a portion of condensed liquid refrigerant from the main refrigerant circuit and to expand the portion of condensed liquid refrigerant. A heat sink is configured to receive the expanded portion of refrigerant from the expansion device. Power electronics are coupled to the heat sink such that the portion of expanded refrigerant from the expansion device passes through the heat sink and cools the power electronics.

18 Claims, 4 Drawing Sheets

(51) Int. Cl.

| | |
|---|---|
| ***F25B 13/00*** | (2006.01) |
| ***F25B 31/00*** | (2006.01) |
| ***F25B 30/06*** | (2006.01) |
| ***F25B 41/04*** | (2006.01) |

(52) U.S. Cl.

CPC ..... *F25B 41/04* (2013.01); *F25B 2313/021* (2013.01); *F25B 2313/02741* (2013.01); *F25B 2400/077* (2013.01)

(56) References Cited

U.S. PATENT DOCUMENTS

| | | | | |
|---|---|---|---|---|
| 3,795,117 | A | 3/1974 | Moody, Jr. et al. | |
| 4,516,406 | A | 5/1985 | Gembtry et al. | |
| 4,598,556 | A | 7/1986 | Mokadam | |
| 4,658,589 | A | 4/1987 | Sutrina | |
| 4,720,981 | A | 1/1988 | Helt et al. | |
| 5,220,809 | A | 6/1993 | Voss | |
| 5,303,561 | A | 4/1994 | Bahel et al. | |
| 5,475,985 | A | 12/1995 | Heinrichs et al. | |
| 5,555,956 | A | 9/1996 | Voss et al. | |
| 5,651,265 | A * | 7/1997 | Grenier | F25B 13/00 165/45 |
| 5,930,135 | A | 7/1999 | Janko | |
| 6,031,751 | A | 2/2000 | Janko | |
| 6,041,609 | A | 3/2000 | Hornsleth et al. | |
| 6,112,535 | A | 9/2000 | Hollenbeck | |
| 6,116,040 | A | 9/2000 | Stark | |
| 6,289,930 | B1 | 9/2001 | Simon | |
| 6,434,960 | B1 | 8/2002 | Rousseau | |
| 6,604,372 | B2 | 8/2003 | Baumert et al. | |
| 6,874,329 | B2 | 4/2005 | Stark et al. | |
| 7,269,962 | B2 | 9/2007 | Bachmann | |
| 8,996,141 | B1 * | 3/2015 | Alsaleem | F25B 49/02 700/37 |
| 2011/0108242 | A1 | 5/2011 | Eichberger et al. | |
| 2012/0255318 | A1 | 10/2012 | Kido et al. | |
| 2013/0036759 | A1 | 2/2013 | Harada et al. | |
| 2013/0145783 | A1 | 6/2013 | Hong | |

FOREIGN PATENT DOCUMENTS

| | | |
|---|---|---|
| EP | 1037001 | 9/2000 |
| JP | 54034158 | 3/1979 |
| JP | 61133770 | 8/1986 |
| JP | 5187724 | 7/1993 |
| JP | 6147666 | 5/1994 |
| JP | 10176867 | 6/1998 |
| JP | 10176867 A * | 6/1998 |
| WO | 2011/077720 | 6/2011 |
| WO | 2011/138864 | 11/2011 |

OTHER PUBLICATIONS

Extended European Search Report, Mar. 8, 2016; European Patent Application No. 13768757.0 (9 pages).

* cited by examiner

SYSTEM AND METHOD FOR COOLING POWER ELECTRONICS USING HEAT SINKS

BACKGROUND

The present invention relates to a system and method for cooling the power electronics of a variable speed heat pump.

High efficiency heat pumps utilizing both a compressor and supply air fan with variable speed drives reduce overall annual energy consumption compared to systems without such drives. These variable speed drives, controlled electronically, include power semiconductors and other electronic components that require cooling, i.e., temperature control, for efficient operation and reliability.

SUMMARY

In one embodiment, a heat pump includes a main refrigerant circuit. The main refrigeration circuit includes a compressor configured to compress a refrigerant, an indoor heat exchanger, and an outdoor heat exchanger. A biflow expansion valve is configured to receive condensed liquid refrigerant and to expand the refrigerant. A reversing valve is movable between a first position that directs refrigerant from the compressor sequentially to the outdoor heat exchanger, the biflow expansion valve, and the indoor heat exchanger in a cooling mode, and a second position that directs compressed refrigerant from the compressor sequentially to the indoor heat exchanger, the biflow expansion valve, and the outdoor heat exchanger in a heating mode. A cooling circuit in fluid communication with the main refrigerant line includes an expansion device configured to receive a portion of condensed liquid refrigerant from the main refrigerant circuit and to expand the portion of condensed liquid refrigerant. A heat sink is configured to receive the expanded portion of refrigerant from the expansion device. Power electronics are coupled to the heat sink such that the portion of expanded refrigerant from the expansion device passes through the heat sink and cools the power electronics.

In another embodiment, a heat pump includes a main refrigerant circuit. The main refrigeration circuit includes a compressor configured to compress a refrigerant, an indoor heat exchanger, and an outdoor heat exchanger. At least one expansion valve is configured to receive condensed liquid refrigerant and to expand the refrigerant. A reversing valve is movable between a first position that directs refrigerant from the compressor sequentially to the outdoor heat exchanger, the at least one expansion valve, and the indoor heat exchanger in a cooling mode, and a second position that directs compressed refrigerant from the compressor sequentially to the indoor heat exchanger, the at least one expansion valve, and the outdoor heat exchanger in a heating mode. A cooling circuit in fluid communication with the main refrigerant line includes a heat sink configured to receive expanded refrigerant. A first orifice check valve is disposed between the heat sink and a first branch point on the main refrigerant circuit between the indoor heat exchanger and the at least one expansion valve. A second orifice check valve is disposed between the heat sink and a second branch point on the main refrigerant circuit between the outdoor heat exchanger and the at least one expansion valve. Each of the first and second orifice check valves is configured to receive a portion of condensed liquid refrigerant from the main refrigerant circuit and to expand the portion of condensed liquid refrigerant. Power electronics are coupled to the heat sink such that the portion of expanded refrigerant from one of the first orifice check valve and the second orifice check valve passes through the heat sink and cools the power electronics.

In another embodiment, a method of operating a heat pump includes directing compressed refrigerant from a compressor sequentially to an outdoor heat exchanger to condense the refrigerant, at least one expansion valve to expand the refrigerant, and an indoor heat exchanger to evaporate the refrigerant in a cooling mode. The method also includes directing compressed refrigerant from the compressor sequentially to the indoor heat exchanger to condense the refrigerant, the at least one expansion valve to expand the refrigerant, and the outdoor heat exchanger to evaporate the refrigerant in a heating mode. The method further includes directing a portion of the condensed refrigerant from a point upstream of the at least one expansion valve toward a heat sink coupled to power electronics, expanding the portion of condensed refrigerant with a fixed orifice expansion device, and directing the portion of expanded refrigerant to the heat sink. The method also includes cooling the heat sink and the power electronics with the expanded portion of the refrigerant.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
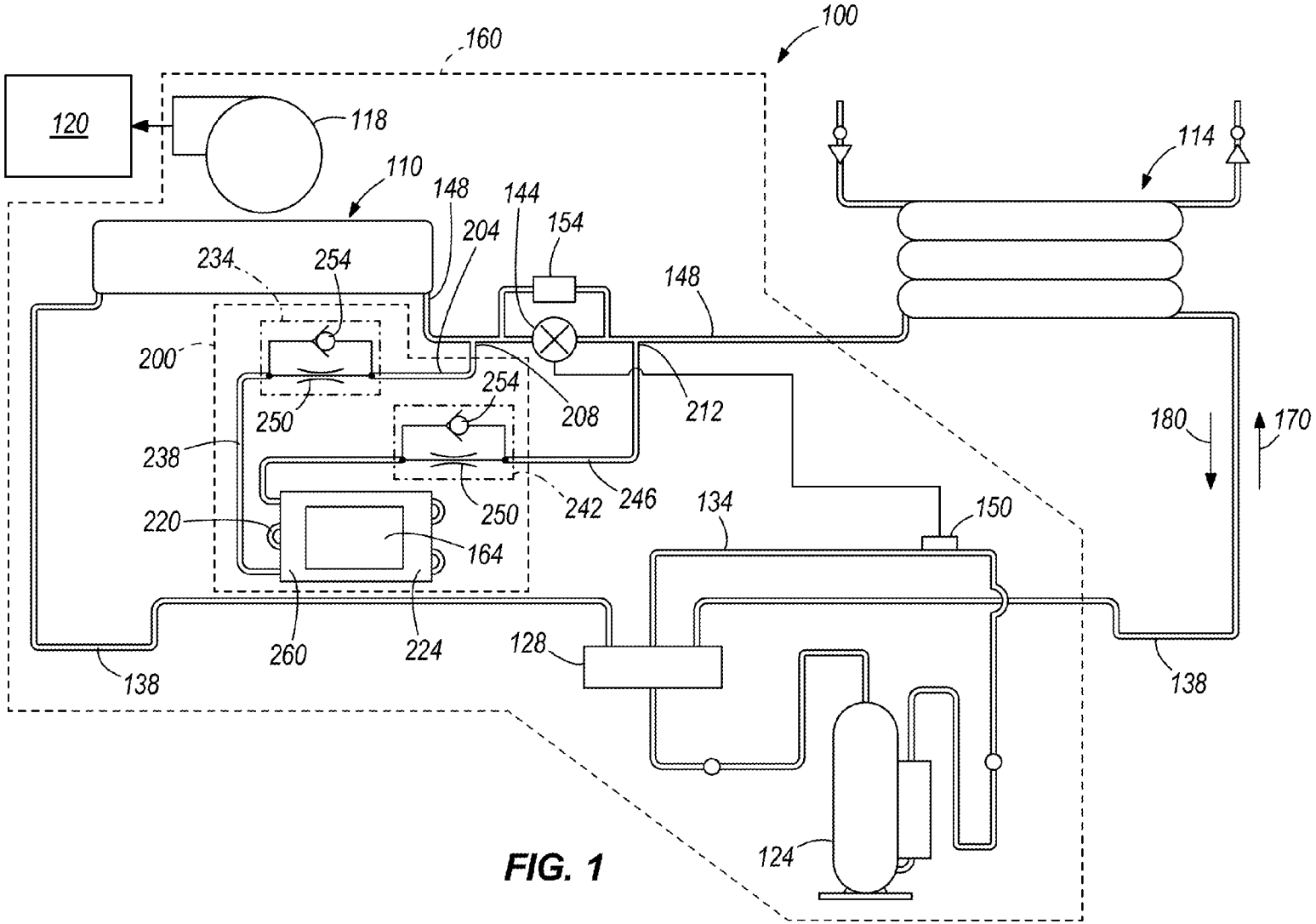
FIG. 1 is a schematic of a high efficiency heat pump having a system for cooling variable speed drive power electronics.

Schematically illustrated in FIG. 1 is a water-source heat pump system 100. The system 100 includes an indoor heat exchanger 110 and an outdoor heat exchanger 114. In the illustrated embodiment, the indoor heat exchanger 110 is a refrigerant-to-air heat exchanger and the outdoor heat exchanger 114 is a refrigerant-to-water heat exchanger, but the heat exchangers 110, 114 are not so limited. For example, in some constructions the outdoor heat exchanger 114 can be a refrigerant-to-air heat exchanger. A variable speed indoor fan 118 forces air across the indoor heat exchanger 110 and supplies that air to a space 120 in order to temper the environment of the space 120. The outdoor heat exchanger 114, which could be, for example, a ground loop or geothermal type of heat exchanger, is in fluid communication with a source of water, which may include a natural source, such as ground water.

A compressor 124, such as a rotary or scroll compressor, discharges gaseous refrigerant to a reversing valve 128. Refrigerant piping includes suction piping 134, which connects the suction port of the compressor 124 to the reversing valve 128, and discharge/return piping 138, which connects the reversing valve 128 to the indoor and outdoor heat exchangers 110, 114, as is commonly known to those of skill in the art. Referring again to FIG. 1, the system 100 includes a bi-flow thermostatic expansion valve ("TXV") 144 positioned in piping 148 connecting the indoor and outdoor heat exchangers 110, 114. The TXV 144 is controlled through a thermal bulb 150 positioned on the suction line 134 and has a separate bleed line orifice 154 that bypasses a portion of the refrigerant flow, for example, 15%. The bi-flow TXV 144, which receives condensed liquid refrigerant and expands it to a vapor/liquid phase mixture, permits in-line direction reversal of the system refrigerant flow to accommodate both the heating mode and the cooling mode of the heat pump system 100 with a single expansion valve. The indoor heat exchanger 110, indoor fan 118, compressor 124, reversing valve 128, and TXV 144 are located within an indoor housing 160.

The reversing valve 128 is movable between a first position that directs refrigerant from the compressor 124 sequentially to the outdoor heat exchanger 114, the TXV 144, and the indoor heat exchanger 110 in a cooling mode (arrow 170), and a second position that directs refrigerant from the compressor 124 sequentially to the indoor heat exchanger 110, the TXV 144, and the outdoor heat exchanger 114 in a heating mode (arrow 180). In the space cooling mode of operation 170, the compressor 124 discharges high temperature/high pressure refrigerant gas to the outdoor heat exchanger 114. The outdoor heat exchanger 114 condenses the refrigerant through thermal contact with the source of cooling water. The condensed refrigerant flows out of the outdoor heat exchanger 114 to the bi-flow TXV 144, where it expands to a lower temperature and pressure, and into the indoor heat exchanger 110, where it vaporizes as heat is transferred from the air directed across the heat exchanger 110 by the fan 118. In the space heating mode of operation 180, the direction of refrigerant flow through the system 100 is reversed as are the functions of the indoor and outdoor heat exchangers 110, 114. In this mode, the indoor heat exchanger 110 functions as a refrigerant condenser while the outdoor heat exchanger 114 functions as a refrigerant evaporator.

In the heat pump system 100 of the present construction, the employment of variable speed drives, specifically a variable speed compressor 124 and a variable speed indoor fan 118, results in the need for power electronics components 164 to control compressor and fan speed. Such components 164, located within the housing 160, inherently generate large amounts of heat, which must be dissipated to prevent the malfunction of the system 100 and its controls.

A cooling circuit 200 includes a cooling line 204 connected at a first end 208 to one side of the TXV 144 at a first branch point on the main refrigerant circuit, and at a second end 212 to the opposite side of the TXV 144 at a second branch point on the main refrigerant circuit. More specifically, the first end 208 of the cooling line 204 corresponds to high pressure condensed refrigerant during the heating mode 180 and low pressure refrigerant in the cooling mode 170. The second end 212 of the cooling line 204 corresponds to high pressure condensed refrigerant during the cooling mode 170 and low pressure refrigerant in the heating mode 180, as shown in FIG. 1.

The cooling line 204 includes a thermal contact portion 220, illustrated as a serpentine tube, intermediate the first end 208 and the second end 212 and which partially forms a heat sink 224, to be further described below. A first orifice check valve 234 is disposed inline with a first leg 238 of the cooling line 204 between the first end 208 and the serpentine tube 220, and a second orifice check valve 242 is disposed inline with a second leg 246 of the cooling line 204 between the second end 212 and the serpentine tube 220. As shown in FIG. 1, each orifice check valve 234, 242 includes a fixed or variable orifice/restrictor 250 in parallel with a check valve 254. Each orifice check valve 234, 242 is arranged to meter refrigerant from the high pressure refrigerant side (dependent on system mode) upstream of the bi-flow TXV 144 to the serpentine tube 220 and to permit substantially unrestricted passage of refrigerant from the serpentine tube 220 to the low pressure refrigerant side downstream of the bi-flow TXV 144.

Figure 2:
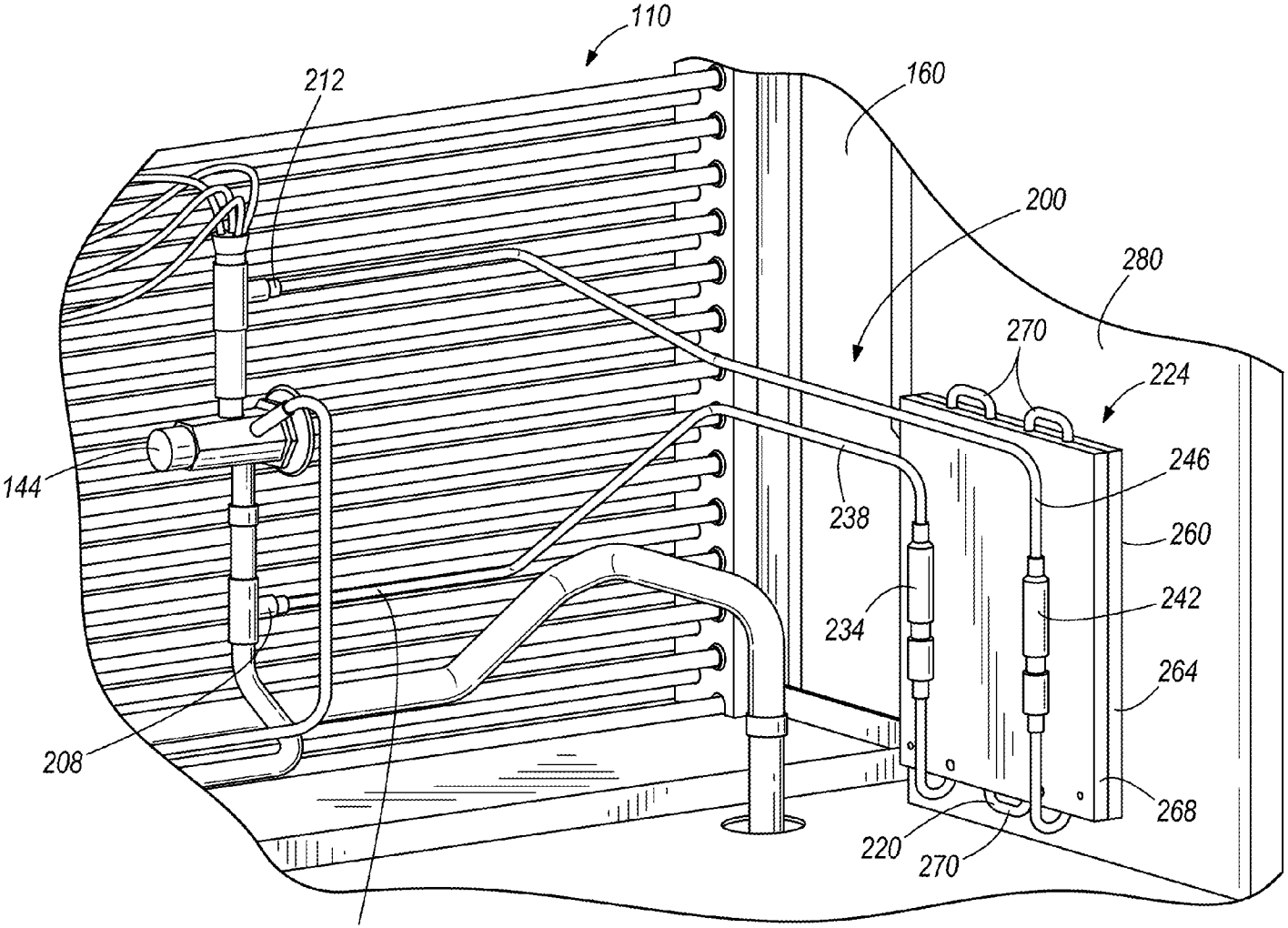
FIG. 2 is a perspective view of the cooling system of FIG. 1 located within a heat pump indoor housing.

Referring to FIG. 2, the cooling circuit 200 is shown located within the housing 160. Clamped about the serpentine tube 220 of the cooling circuit 200 is a block of material 260. The block of material 260 is preferably fabricated in two sections 264, 268 cooperating to define an internal passage (not shown) into which the serpentine tube 220 can be secured, and is further preferably formed from a heat conducting material such as aluminum. The effect of clamping the halves 264, 268 of the material block 260 tightly over the serpentine tube 220 of the cooling line 204 is to create an efficient path for the transfer of heat between the block 260 and the serpentine tube 220, which together form the heat sink 224.

While the curved ends 270 of the serpentine tube 220 are illustrated as exposed and outside of the block 260, the block 260 can alternatively be fabricated to define a cooperating serpentine passage such that none of the serpentine tube 220 is exposed. In a further alternative, rather than running through the block of material 260, the serpentine tube 220 could be interrupted and the block 260 spliced into the cooling line 204 so that system refrigerant flows through and in direct contact with the block 260. In such a case, the block 260 may be a unitary piece into which a flow passage has been cast, with the interrupted ends of the serpentine tube 220 brazed into the passage orifices of the block 260.

The serpentine tube 220 is not limited to four passes through the block 260 and can have fewer or more than four passes depending on the size of the block 260 and the amount of heat to be absorbed (itself dependent on the power electronics used and the size of the equipment). In other constructions, the tube 220 need not be in serpentine form and other tube shapes, as well as variations in the configuration of the block 260, are considered to be within the scope of the present invention. For instance, refrigerant might pass through the block unidirectionally and/or in a single pass.

Figure 3:
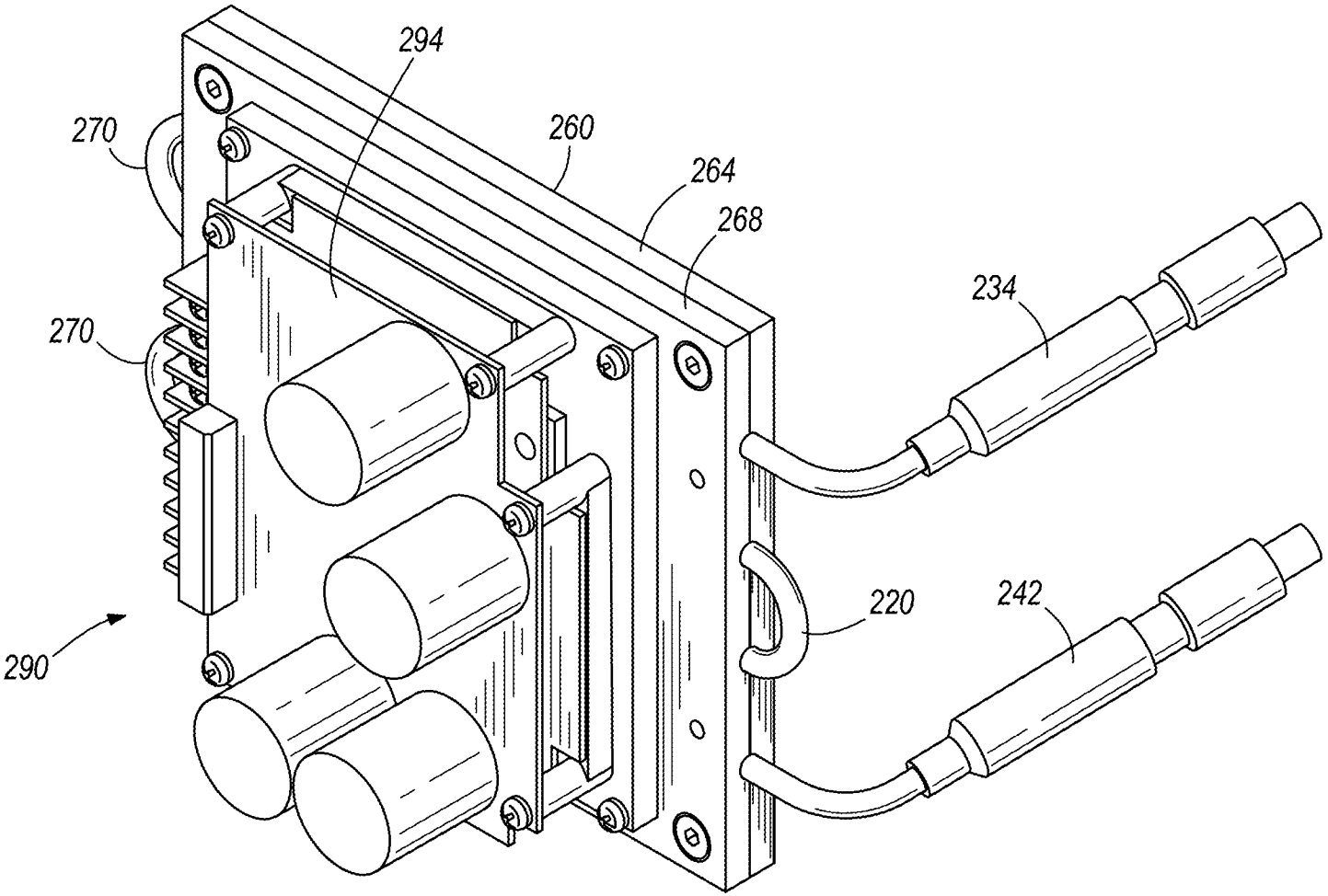
FIG. 3 is another perspective view of the cooling system shown in FIG. 2.

Referring again to FIG. 2, the block 260 is supported within the housing 160 by fasteners, such as bolts, which pass through the block 260 and a panel 280 of the housing 160, with the exact location a matter of application preference based on the capacity of the system 100. For example, the panel 280 of FIG. 2 may be a rear panel of an externally accessible power electronics box of the housing 160. Referring to FIG. 3, the block 260 is configured to accept the mounting of power electronic modules 290. The term "power electronic modules" will be used herein to refer to all electronic components mounted on the block 260 through which the speed of the compressor 124 and/or the speed of the indoor fan 118 is/are controlled and varied. These components function with and are connected to power leads (not shown), which direct power to the compressor and fan 124, 118, and it will be appreciated that a large amount of heat is generated within the modules 290. The modules 290 are attached to the block 260 in a manner that facilitates the transfer of heat to the block 260. For example, the modules 290 can be attached to a circuit card or board 294 on which various other compressor and/or fan speed control related components are mounted. The reliability and life of the modules 290 is to a significant degree dependent upon precluding such components from operating at high temperatures and/or precluding their exposure to thermal shock.

In some applications, a layer of insulation (not shown) is disposed around the outer edge of the block 260 to hinder heat absorption from ambient conditions inside the housing 160 or from other sources other than the modules 290.

In the cooling mode of operation 170, refrigerant passes from the compressor 124 first to the outdoor heat exchanger 114, where it condenses, and then to the bi-flow TXV 144. A portion of the refrigerant upstream of the TXV 144 is redirected through the second end 212 of the cooling line 204. This portion of refrigerant passes within the second leg 246, through the second orifice check valve 242 (and specifically through the orifice/restrictor 250 of the second orifice check valve 242, which expands the refrigerant), and to the serpentine tube 220. As this low-temperature refrigerant passes through the serpentine tube 220 in thermal contact with the block 260, the heat generated within the modules 290 used to power and control the compressor 124 passes into the heat sink 224, which absorbs heat due to the temperature differential between the heat generating modules 290 and the refrigerant being pumped through the serpentine tube 220. The refrigerant then passes from the tube 220 to the first leg 238, through the first orifice check valve 234 (and specifically through the open check valve 254 of the first orifice check valve 234), and to the first end 208 of the cooling line 204, where it joins and mixes with the main refrigerant flow in piping 148 downstream of the TXV 144 and upstream of the indoor heat exchanger 110.

In the heating mode 180, the flow of refrigerant is reversed, with refrigerant passing from the compressor 124 first to the indoor heat exchanger 110 and to the TXV 144. A portion of refrigerant is redirected through the first end 208 of the cooling line 204 and the orifice/restrictor 250 of the first orifice check valve 234, through the serpentine tube 220, past the open check valve 254 of the second orifice check valve 242, and to the second end 212 of the cooling line 204. This refrigerant joins and mixes with the main refrigerant flow in piping 148 downstream of the TXV 144 and upstream of the outdoor heat exchanger 114.

The amount of refrigerant redirected to the cooling circuit is a function of the pressure differential across the bi-flow TXV 144 and in normal operation is at or less than approximately 10-15 Ibm of refrigerant per hour in both cooling and heating modes 170, 180. It is to be noted that the faster the speed of the compressor 124 in operation, the greater is the pressure differential across the TXV 144 and therefore the greater the amount of refrigerant redirected through the cooling circuit 200 in a given period of time. The circuit 200 is therefore self-regulating in that when the compressor 124 is running at higher speeds due to increased load a greater quantity of refrigerant is pumped through the cooling circuit 200 and is brought into a heat exchange relationship with the modules 290 generating the heat.

Figure 4:
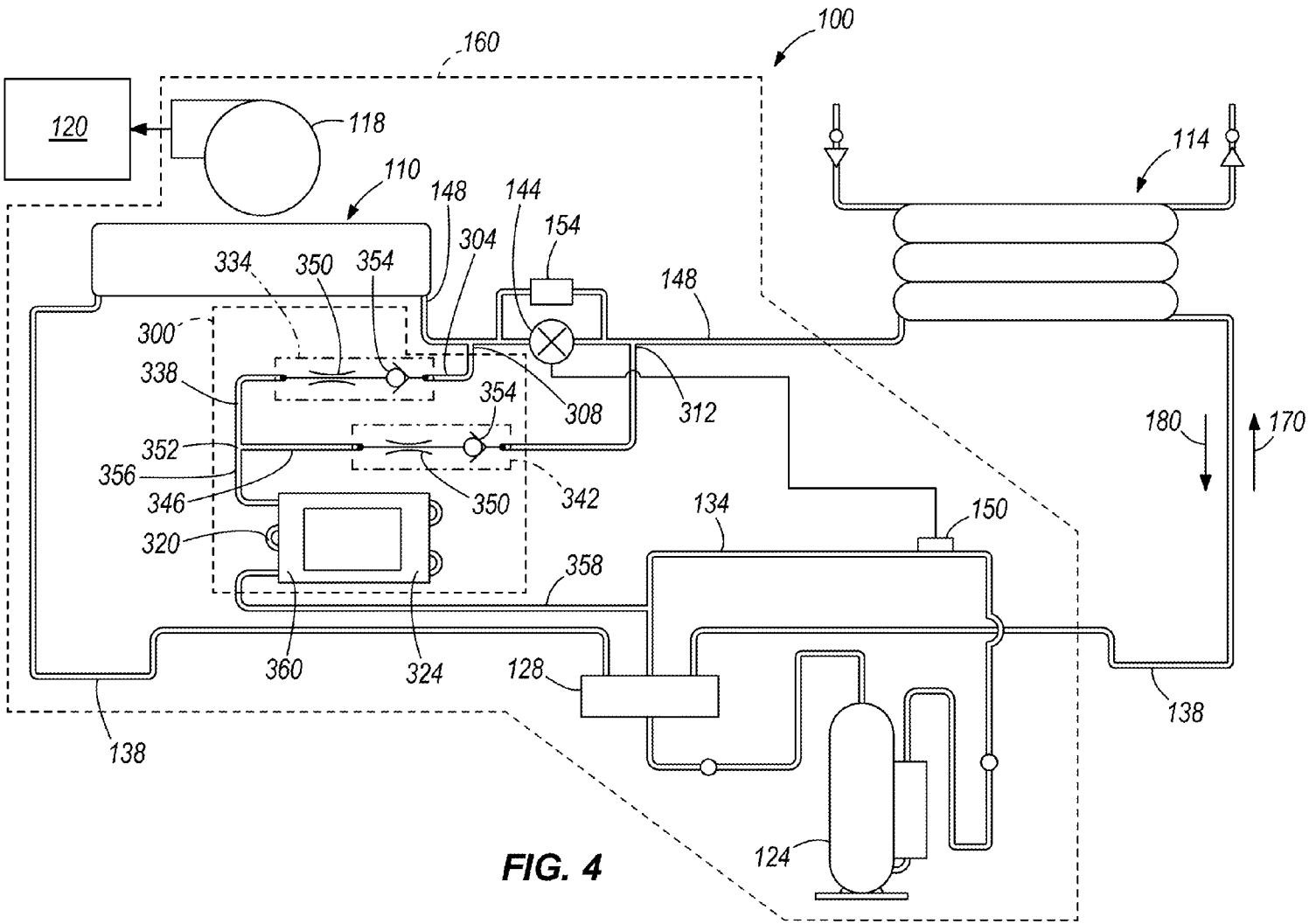
FIG. 4 is a schematic of a high efficiency heat pump having an alternatively configured system for cooling variable speed drive power electronics.

Referring to FIG. 4, in an alternative construction, a cooling line 304 includes a serpentine tube 320 downstream of both a first end 308 at a first branch point on the main refrigerant circuit and a second end 312 at a second branch point on the main refrigerant circuit, and which partially forms a heat sink 324. The heat sink 324 includes a block 360, substantially identical to the block 260 of the heat sink 224. A first orifice check valve 334 is disposed inline with a first leg 338 of the cooling line 304 between the first end 308 and the serpentine tube 320, and a second orifice check valve 342 is disposed inline with a second leg 346 of the cooling line 304 between the second end 312 and the serpentine tube 320. As shown in FIG. 4, each orifice check valve 334, 342 includes a fixed or variable orifice/restrictor 350 in series with a check valve 354 and is arranged to meter refrigerant from the high pressure refrigerant side upstream of the bi-flow TXV 144 to the serpentine tube 320. The series arrangement of the orifice/restrictors 350 and respective check valves 354, together with the orientation of the check valves 354, inhibits the flow of refrigerant to the low pressure refrigerant side downstream of the bi-flow TXV 144, i.e., to first end 308 during the cooling mode 170 or to the second end 312 during the heating mode 180.

The first leg 338 and the second leg 346 meet at an intersection 352 to form a third leg 356 extending therefrom. From the third leg 356, the refrigerant flows to the serpentine tube 320. As opposed to returning to the low pressure side downstream of the TXV 144, the refrigerant instead flows out of the serpentine tube 320 and through a fourth leg 358 leading to the compressor suction line 134. In a variation of the alternative construction, in lieu of the first orifice check valve 334 in the first leg 338 and the second orifice check valve 342 in the second leg 346, a single orifice restrictor similar to orifice 350 can be positioned in the third leg 356, with each of the first and second legs 338, 346 including only a check valve similar to the check valve 354. In some constructions, the legs 338, 346, 356 can form a Y-shape, although other shaped configurations are within the scope of the invention.

In the heating mode of operation 180, refrigerant passes from the compressor 124 first to the indoor heat exchanger 110, where it condenses, and then to the bi-flow TXV 144. A portion of the refrigerant upstream of the TXV 144 is redirected through the first end 308 of the cooling line 304. This portion of refrigerant passes within the first leg 338, through the first orifice check valve 334, to the third leg 356, and to the serpentine tube 320 where it absorbs heat from the block 360 in thermal contact with the power modules 290. Upon exiting the serpentine tube 320, the refrigerant is directed through the fourth leg 358 to the compressor suction line 134 upstream of the compressor 124 and mixes with the refrigerant evaporated by the outdoor heat exchanger 114.

In the cooling mode 170, the flow of refrigerant is reversed, with refrigerant passing from the compressor 124 first to the outdoor heat exchanger 114 and to the TXV 144, where a portion of refrigerant is redirected through the second end 312 of the cooling line 304 and the orifice/restrictor 350 of the second orifice check valve 342 before proceeding through the serpentine tube 320, the fourth leg 358, and to the compressor suction line 134, substantially as described above.

Portions of the present invention are equally applicable to cooling-only air conditioning applications, i.e., in which the flow of refrigerant is at all times from a compressor to an outdoor heat exchanger coil.

The heat produced from the power electronics and other speed control components must be efficiently transported away to prevent their failure due to over-heating. If the operating temperatures of critical compressor speed control components can be maintained at less than 185° F., the reliability and life of such components is dramatically enhanced. Testing has determined that under normal operating conditions, the surface temperature of the block 260, 360 ranges between about 25° F. and about 90° F. over the complete system 100 operating range, indicating that compressor speed control components are operating at temperatures well below acceptable upper limits.

Various features and advantages of the invention are set forth in the following claims.

What is claimed is:

1. A heat pump comprising:

a main refrigerant circuit including a compressor configured to compress a refrigerant, an indoor heat exchanger, an outdoor heat exchanger, a biflow expansion valve configured to receive condensed liquid refrigerant and to expand the refrigerant, and a reversing valve movable between a first position that directs refrigerant from the compressor sequentially to the outdoor heat exchanger, the biflow expansion valve, and the indoor heat exchanger in a cooling mode, and a second position that directs compressed refrigerant from the compressor sequentially to the indoor heat exchanger, the biflow expansion valve, and the outdoor heat exchanger in a heating mode; and a cooling circuit in fluid communication with the main refrigerant circuit, the cooling circuit including a cooling line having a first end and a second end, the first end is at a first branch point on the main refrigerant circuit, the first branch point is between the indoor heat exchanger and the biflow expansion valve, the second end is at a second branch point on the main refrigerant circuit, the second branch point is between the outdoor heat exchanger and the biflow expansion valve, the cooling line further includes a first leg fluidly connected with the first branch point, and a second leg fluidly connected with the second branch point, a first expansion device on the first leg, a second expansion device on the second leg, a heat sink fluidly connected with the first leg and the second leg, the first expansion device, in a heating mode, receives a portion of condensed liquid refrigerant from the main refrigerant circuit, the first expansion device including a first orifice check valve having a first orifice, the first orifice check valve is disposed between the heat sink and the first branch point, the first orifice expands the portion of condensed refrigerant in the heating mode, the second expansion device, in a cooling mode, receives a portion of condensed refrigerant from the main refrigerant circuit, the second expansion device including a second orifice check valve having a second orifice, the second orifice check valve is disposed between the heat sink and the second branch point, the second orifice expands the portion of condensed refrigerant in the cooling mode, the heat sink receives the expanded portion of refrigerant from the first or second expansion device, respectively in the heating or cooling mode, and power electronics coupled to the heat sink, the portion of expanded refrigerant passing through the heat sink and cooling the power electronics.

2. The heat pump of claim 1, wherein the power electronics are variable frequency drive (VFD) components.

3. The heat pump of claim 2, wherein the compressor is a variable speed compressor and the VFD components control the speed of the compressor.

4. The heat pump of claim 2, further comprising a supply air fan configured to force air through the indoor heat exchanger, the supply air fan driven by a variable speed motor, wherein the VFD components control the speed of the variable speed motor.

5. The heat pump of claim 1, wherein the portion of expanded refrigerant from the heat sink is returned to the main refrigerant circuit downstream of the biflow expansion valve to mix with the refrigerant expanded by the biflow expansion valve.

6. The heat pump of claim 1, wherein the portion of expanded refrigerant from the heat sink is returned to the main refrigerant circuit upstream of the compressor to mix with the refrigerant evaporated by one of the indoor heat exchanger and the outdoor heat exchanger.

7. The heat pump of claim 1, wherein the biflow expansion valve is a thermostatic expansion valve having a 15% bleed.

8. The heat pump of claim 1, wherein the first expansion device of the cooling circuit is a fixed orifice valve, and the second expansion device of the cooling circuit is a fixed orifice valve.

9. A heat pump comprising:

a main refrigerant circuit including a compressor configured to compress a refrigerant, an indoor heat exchanger, an outdoor heat exchanger, at least one expansion valve configured to receive condensed liquid refrigerant and to expand the refrigerant, a reversing valve movable between a first position that directs refrigerant from the compressor sequentially to the outdoor heat exchanger, the at least one expansion valve, and the indoor heat exchanger in a cooling mode, and a second position that directs compressed refrigerant from the compressor sequentially to the indoor heat exchanger, the at least one expansion valve, and the outdoor heat exchanger in a heating mode; and a cooling circuit in fluid communication with the main refrigerant circuit, the cooling circuit including a cooling line having a first end and a second end, the first end is at a first branch point on the main refrigerant circuit, the first branch point is between the indoor heat exchanger and the at least one expansion valve, the second end is at a second branch point on the main refrigerant circuit, the second branch point is between the outdoor heat exchanger and the at least one expansion valve, the cooling line further includes a first leg fluidly connected with the first branch point, and a second leg fluidly connected with the second branch point, a first expansion device on the first leg, a second expansion device on the second leg, a heat sink fluidly connected with the first leg and the second leg, the first expansion device, in a heating mode, receives a portion of condensed liquid refrigerant from the main refrigerant circuit, the first expansion device including a first orifice check valve having a first orifice, the first orifice check valve is disposed between the heat sink and the first branch point, the first orifice expands the portion of condensed refrigerant in the heating mode, the second expansion device, in a cooling mode, receives a portion of condensed refrigerant from the main refrigerant circuit, the second expansion device including a second orifice check valve having a second orifice, the second orifice check valve is disposed between the heat sink and the second branch point, the second orifice expands the portion of condensed refrigerant in the cooling mode the heat sink receives the expanded portion of refrigerant from the first or second expansion device, respectively in the heating or cooling mode, and power electronics coupled to the heat sink, the portion of expanded refrigerant passing through the heat sink and cooling the power electronics.

10. The heat pump of claim 9, wherein the second orifice check valve, in the heating mode, allows substantially unrestricted passage of the portion of expanded refrigerant from the first orifice check valve to the second branch point.

11. The heat pump of claim 9, wherein the main refrigerant circuit includes a suction line between the reversing valve and the compressor, and wherein the cooling circuit further includes a branch line that fluidly connects the heat sink to a third branch point on the suction line, and wherein the second orifice check valve, in the heating mode, inhibits passage of the portion of expanded refrigerant from the first orifice check valve to the second branch point such that the portion of expanded refrigerant is directed to the suction line through the branch line to mix with the refrigerant evaporated in the outdoor heat exchanger.

12. The heat pump of claim 9, wherein the first orifice check valve, in the cooling mode, allows substantially unrestricted passage of the portion of expanded refrigerant from the second orifice check valve to the first branch point.

13. The heat pump of claim 9, wherein the main refrigerant circuit includes a suction line between the reversing valve and the compressor, and wherein the cooling circuit further includes a branch line that fluidly connects the heat sink to a third branch point on the suction line, and wherein the first orifice check valve, in the cooling mode, inhibits passage of the portion of expanded refrigerant from the second orifice check valve to the first branch point such that the portion of expanded refrigerant is directed to the suction line through the branch line to mix with the refrigerant evaporated in the indoor heat exchanger.

14. The heat pump of claim 9, wherein the power electronics are variable frequency drive (VFD) components.

15. The heat pump of claim 14, wherein the compressor is a variable speed compressor and the VFD components control the speed of the compressor.

16. The heat pump of claim 15, wherein each of the first and second orifice check valves includes a fixed orifice valve.

17. The heat pump of claim 14, further comprising a supply air fan configured to force air through the indoor heat exchanger, the supply air fan driven by a variable speed motor, wherein the VFD components control the speed of the variable speed motor.

18. A method of operating a heat pump, the method comprising:

directing, in a main refrigerant circuit, compressed refrigerant from a compressor sequentially to an outdoor heat exchanger to condense the refrigerant, at least one expansion valve to expand the refrigerant, and an indoor heat exchanger to evaporate the refrigerant in a cooling mode;

directing, in the main refrigerant circuit, compressed refrigerant from the compressor sequentially to the indoor heat exchanger to condense the refrigerant, the at least one expansion valve to expand the refrigerant, and the outdoor heat exchanger to evaporate the refrigerant in a heating mode;

directing a portion of the condensed refrigerant, into a cooling circuit, from a point upstream of the at least one expansion valve, with respect to the cooling mode or the heating mode, and toward a heat sink coupled to power electronics;

expanding the portion of condensed refrigerant;

directing the portion of expanded refrigerant to the heat sink; and cooling the heat sink and the power electronics with the expanded portion of the refrigerant, the cooling circuit is in fluid communication with the main refrigerant circuit, the cooling circuit including a cooling line having a first end and a second end, the first end is at a first branch point on the main refrigerant circuit, the first branch point is between the indoor heat exchanger and the at least one expansion valve, the second end is at a second branch point on the main refrigerant circuit, the second branch point is between the outdoor heat exchanger and the at least one expansion valve, the cooling line further includes a first leg fluidly connected with the first branch point, and a second leg fluidly connected with the second branch point, a first expansion device on the first leg, a second expansion device on the second leg, the heat sink is fluidly connected with the first leg and the second leg, the first expansion device, in the heating mode, receives a portion of condensed liquid refrigerant from the main refrigerant circuit, the first expansion device including a first orifice check valve having a first orifice, the first orifice check valve is disposed between the heat sink and the first branch point, the first orifice expands the portion of condensed refrigerant in the heating mode, the second expansion device, in the cooling mode, receives a portion of condensed refrigerant from the main refrigerant circuit, the second expansion device including a second orifice check valve having a second orifice, the second orifice check valve is disposed between the heat sink and the second branch point, the second orifice expands the portion of condensed refrigerant in the cooling mode the heat sink receives the expanded portion of refrigerant from the first or second expansion device, respectively in the heating or cooling mode, and the power electronics is coupled to the heat sink, the portion of expanded refrigerant passing through the heat sink and cooling the power electronics.

* * * * *